US007530476B2

(12) United States Patent
Downey et al.

(10) Patent No.: US 7,530,476 B2
(45) Date of Patent: May 12, 2009

(54) LOCKING AEROSOL DISPENSER

(75) Inventors: Michael Paul Downey, Tarrytown, NY (US); Timothy O'Toole, Yorktown Heights, NY (US)

(73) Assignee: Precision Valve Corporation, Yonkers, NY (US)

( * ) Notice: Subject to any disclaimer, the term of this patent is extended or adjusted under 35 U.S.C. 154(b) by 263 days.

(21) Appl. No.: 11/401,158

(22) Filed: Apr. 10, 2006

(65) Prior Publication Data

US 2007/0235474 A1 Oct. 11, 2007

(51) Int. Cl.
*B67B 5/00* (2006.01)
*B65D 83/00* (2006.01)

(52) U.S. Cl. ..... 222/153.11; 222/402.13; 222/402.11; 222/153.04

(58) Field of Classification Search ..... 222/402.1, 222/402.11, 402.13, 402.23, 402.25, 153.11, 222/153.1, 153.12, 153.03, 153.04, 153.14, 222/153.13, 402.24
See application file for complete search history.

(56) References Cited

U.S. PATENT DOCUMENTS

| | | | | |
|---|---|---|---|---|
| D133,910 | S | 9/1942 | Houghton | |
| 2,706,660 | A * | 4/1955 | Johnson et al. | 251/89 |
| 3,050,219 | A | 8/1962 | Sagarin et al. | |
| 3,178,120 | A | 4/1965 | Kappel | |
| 3,185,350 | A | 5/1965 | Abplanalp | |
| 3,325,054 | A | 6/1967 | Braun | |
| 3,422,996 | A | 1/1969 | Lipman | |
| 3,424,353 | A | 1/1969 | Meador et al. | |
| 3,426,948 | A * | 2/1969 | Stirling | 222/402.11 |
| 3,591,128 | A | 7/1971 | Ramis | |
| 3,675,831 | A | 7/1972 | Beres | |
| 3,680,605 | A | 8/1972 | Nigro | |
| 3,722,748 | A | 3/1973 | Wakeman et al. | |
| 3,744,682 | A | 7/1973 | Blank | |
| 3,749,286 | A | 7/1973 | Douglas | |
| 3,828,982 | A | 8/1974 | Steigerwald | |
| 3,924,782 | A | 12/1975 | Starrett | |
| 4,024,988 | A | 5/1977 | Starrett | |
| 4,065,036 | A | 12/1977 | Kirk, Jr. | |
| 4,132,333 | A | 1/1979 | Debard | |
| 4,413,756 | A | 11/1983 | Kirley | |

(Continued)

FOREIGN PATENT DOCUMENTS

| | | |
|---|---|---|
| DE | 19960845 | 5/2001 |

(Continued)

*Primary Examiner*—Kevin P Shaver
*Assistant Examiner*—Stephanie E Tyler
(74) *Attorney, Agent, or Firm*—Ohlandt, Greeley, Ruggiero & Perle, L.L.P.

(57) ABSTRACT

A locking aerosol dispenser with a dome, a top thermoplastic elastomeric button member molded over a dome opening, and a base lock member. The rotatable base lock rotates from locked to unlocked position with respect to the essentially non-rotatable dome. A product channel member in the dome is held by the elastomeric button, and not otherwise attached to the dome. The base lock has an upstanding bridge with unlocking slots within which extend fingers on the product channel member when the dispenser is unlocked and actuated. The base lock is not attached to the aerosol valve mounting cup. The dome is attached to the base lock member and the aerosol valve mounting cup, the dome capturing the base lock member between the dome and aerosol container.

18 Claims, 13 Drawing Sheets

U.S. PATENT DOCUMENTS

| | | | | |
|---|---|---|---|---|
| 4,418,842 | A | 12/1983 | DiLoreto | |
| 4,420,096 | A | 12/1983 | Kirk, Jr. | |
| 4,542,837 | A | 9/1985 | Rayner | |
| 4,572,410 | A | 2/1986 | Brunet | |
| 4,582,228 | A | 4/1986 | Diamond et al. | |
| 4,848,595 | A * | 7/1989 | Foster et al. | 222/153.13 |
| 5,158,206 | A | 10/1992 | Kobayashi et al. | |
| 5,203,841 | A | 4/1993 | Kitabayashi | |
| 5,282,551 | A | 2/1994 | Pierson | |
| 5,379,924 | A | 1/1995 | Taylor | |
| 5,385,303 | A | 1/1995 | Gosselin et al. | |
| D365,990 | S | 1/1996 | McSwiggan et al. | |
| 5,743,468 | A | 4/1998 | Laidler | |
| 5,779,109 | A | 7/1998 | Gueret | |
| 5,927,563 | A | 7/1999 | Kellner | |
| 5,927,604 | A | 7/1999 | Laidler | |
| 5,957,337 | A | 9/1999 | Bettison, Jr. | |
| 5,971,214 | A | 10/1999 | Bettison, Jr. | |
| 5,971,230 | A | 10/1999 | Tanaka | |
| 6,016,939 | A | 1/2000 | Gueret | |
| 6,029,866 | A | 2/2000 | Wood et al. | |
| 6,112,953 | A | 9/2000 | Gueret | |
| 6,161,736 | A | 12/2000 | Kaufman et al. | |
| 6,302,302 | B1 | 10/2001 | Albisetti | |
| 6,338,424 | B2 | 1/2002 | Nakamura et al. | |
| 6,367,711 | B1 | 4/2002 | Benoist | |
| 6,401,990 | B1 | 6/2002 | Walters et al. | |
| 6,454,139 | B1 | 9/2002 | Bayer | |
| 6,497,346 | B1 | 12/2002 | Dubois et al. | |
| 6,523,722 | B1 | 2/2003 | Clark et al. | |
| 6,601,735 | B2 | 8/2003 | Milian et al. | |
| 6,758,373 | B2 * | 7/2004 | Jackson et al. | 222/153.11 |
| 6,877,643 | B2 | 4/2005 | Schneider | |
| 6,959,879 | B2 | 11/2005 | Laidler et al. | |
| 6,971,552 | B2 | 12/2005 | Meshberg | |
| 2005/0017027 | A1 | 1/2005 | Yerby et al. | |
| 2005/0121473 | A1 | 6/2005 | Matsuyama | |
| 2005/0133542 | A1 | 6/2005 | Kolanus | |
| 2005/0184093 | A1 | 8/2005 | Brunerie et al. | |

FOREIGN PATENT DOCUMENTS

| | | |
|---|---|---|
| EP | 1040055 | 7/1999 |
| WO | WO 98/16439 | 4/1998 |
| WO | WO 01/85573 | 11/2001 |

* cited by examiner

LOCKING AEROSOL DISPENSER

FIELD OF THE INVENTION

The present invention relates to aerosol dispensers of the type often referred to as spray dome dispensers or actuators. More particularly, the present invention relates to such a dispenser having a top portion mounted on a bottom portion which is rotatable with respect to the top portion between a first operative position for valve actuation and a second inoperative position in which the valve cannot be actuated.

BACKGROUND OF THE INVENTION

Prior art locking aerosol dispensers have existed for many years and have had many different structural designs of interrelating parts. Some of these designs are overly complex to mold, while others require more force than desirable for the user to operate between the inoperative and operative positions. Still other designs require more force than desirable to actuate the aerosol valve. Further designs have created leaking problems. Additional designs are not sufficiently robust and are vulnerable to damage to their parts and operation due to excessive top loads from misuse, handling, shipping, etc.

SUMMARY OF THE INVENTION

The present invention is intended to provide a locking aerosol dispenser that is robust in its construction, easily molded and assembled, easy to operate between its inoperative and operative positions, easy to actuate, and functions reliably and efficiently.

The locking aerosol dispenser of the present invention is intended for mounting on a product container having an aerosol valve with mounting cup and valve stem at the top of the container. The dispenser includes a rotatable base lock member unattached to the mounting cup to facilitate ease of rotation between the on-unlocked position and off-locked position. This base lock member further has a bridge extending upwardly above and across the central opening of the base lock member. The bridge member in turn has a central opening and unlocking slots adjacent thereto.

A dome member that is not intended to be rotatable in operation extends above the base lock member, attaches to the mounting cup, attaches to the base lock member, and captures the base lock member between the dome and product container. The dome member further includes a product channel member that is connected to the dome member by a thermoplastic elastomeric button member molded over an opening at the top of the dome, over dome surfaces adjacent the opening, and over the product channel. The product channel at its opposite end connects to the valve stem. The product channel moves easily up and down due to the resiliency of the button member.

The product channel member further includes side finger extensions or fins that extend into the bridge locking slots in the on-unlocked position of the base lock member to allow depression of the product channel member and actuation of the valve stem. The side finger extensions or fins cannot extend into the bridge locking slots in the off-locked position of the base lock member thus preventing the product channel member from depressing and actuating the aerosol valve stem.

The mounting cup is directly adjacent to and supports the bridge member against excessive downward pressure due to top-loading on the top button when the actuator is in its off-locked position. Damage to the dispenser is thereby avoided.

Means to visually indicate the off and on operative positions of the dispenser are also provided including a flange on the base lock member and a depression in the dome member.

Other features and advantages of the present invention will be apparent from the following description, drawings and claims.

DETAILED DESCRIPTION OF EMBODIMENT

Figure 1:
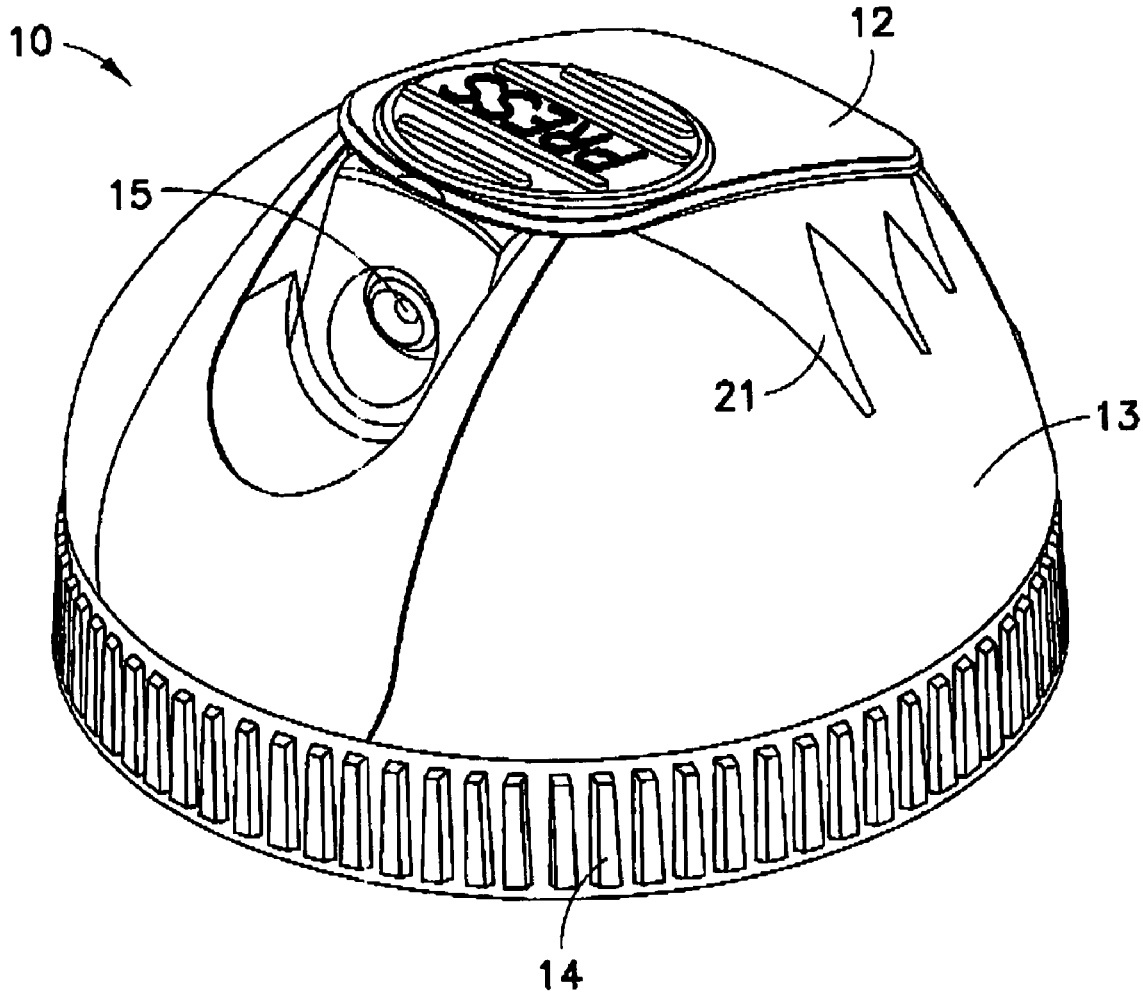
FIG. 1 is a perspective view of the locking aerosol dispenser of the present invention.
Figure 2:
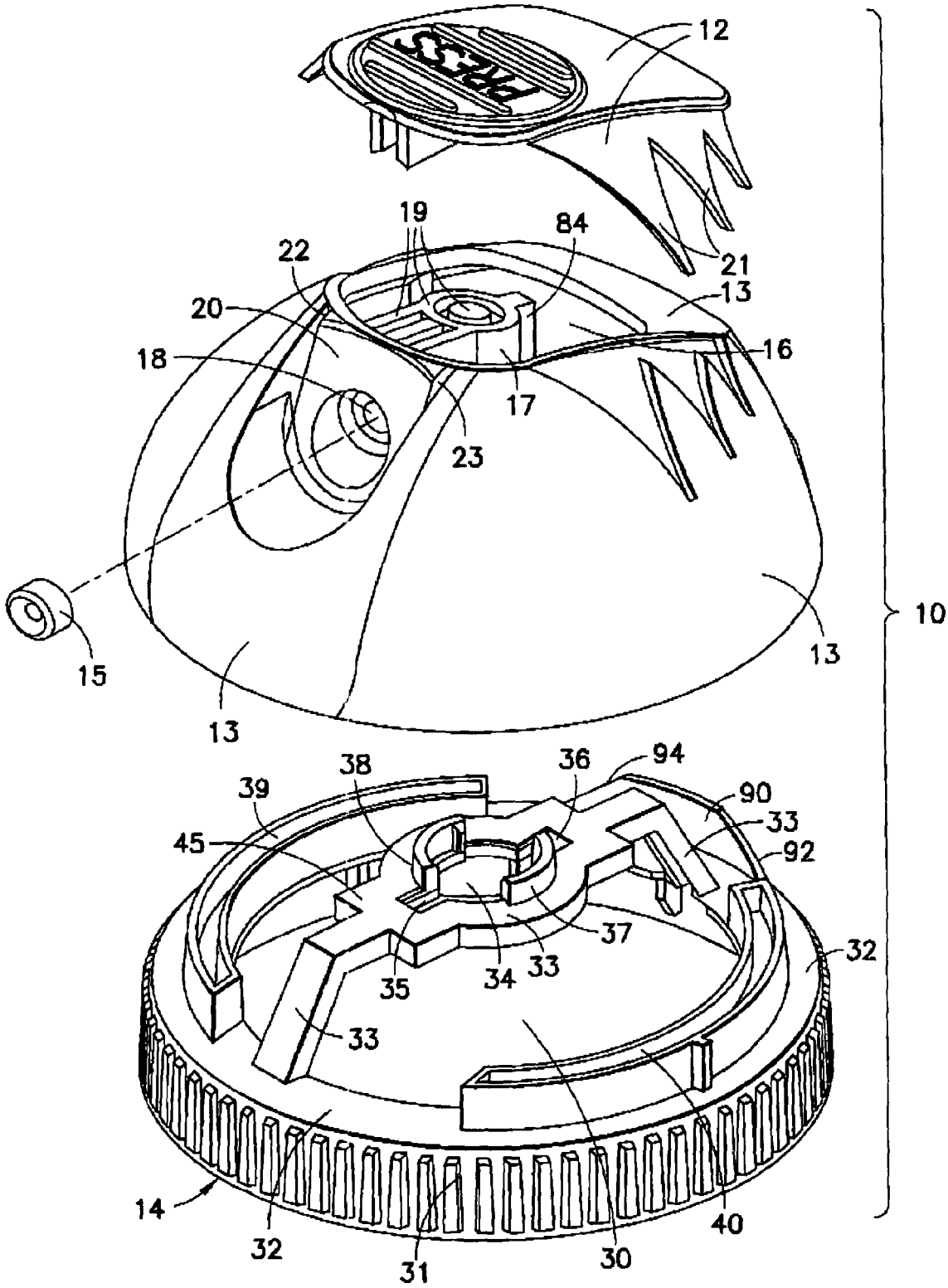
FIG. 2 is an exploded view of FIG. 1, illustrating the dome member, the thermoplastic elastomeric button member, and the base locking member of the present invention.
Figure 3:
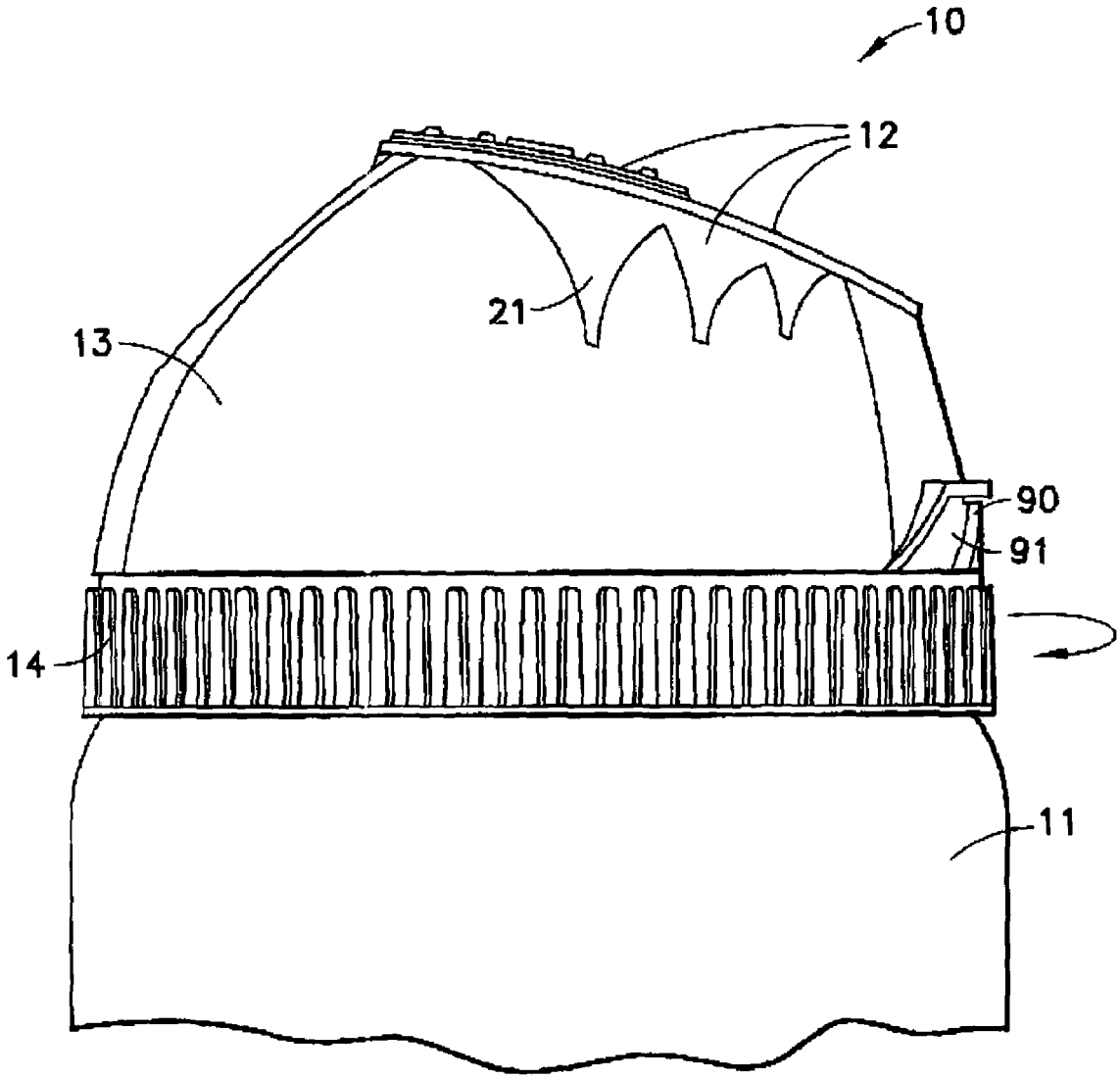
FIG. 3 is a side view of the locking aerosol dispenser of the present invention mounted on the top of an aerosol container.
Figure 4:
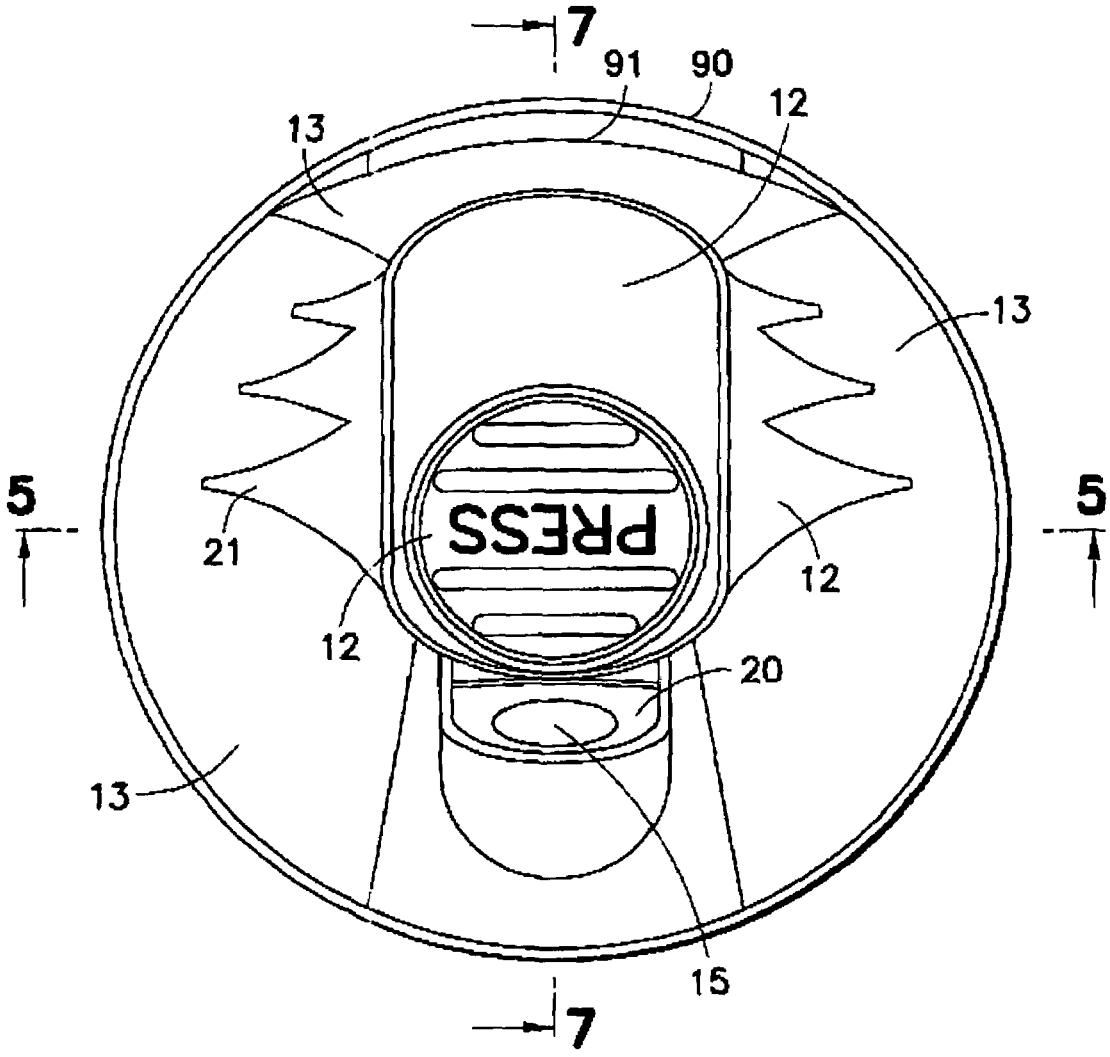
FIG. 4 is a top plan view of the locking aerosol dispenser of the present invention.
Figure 6:
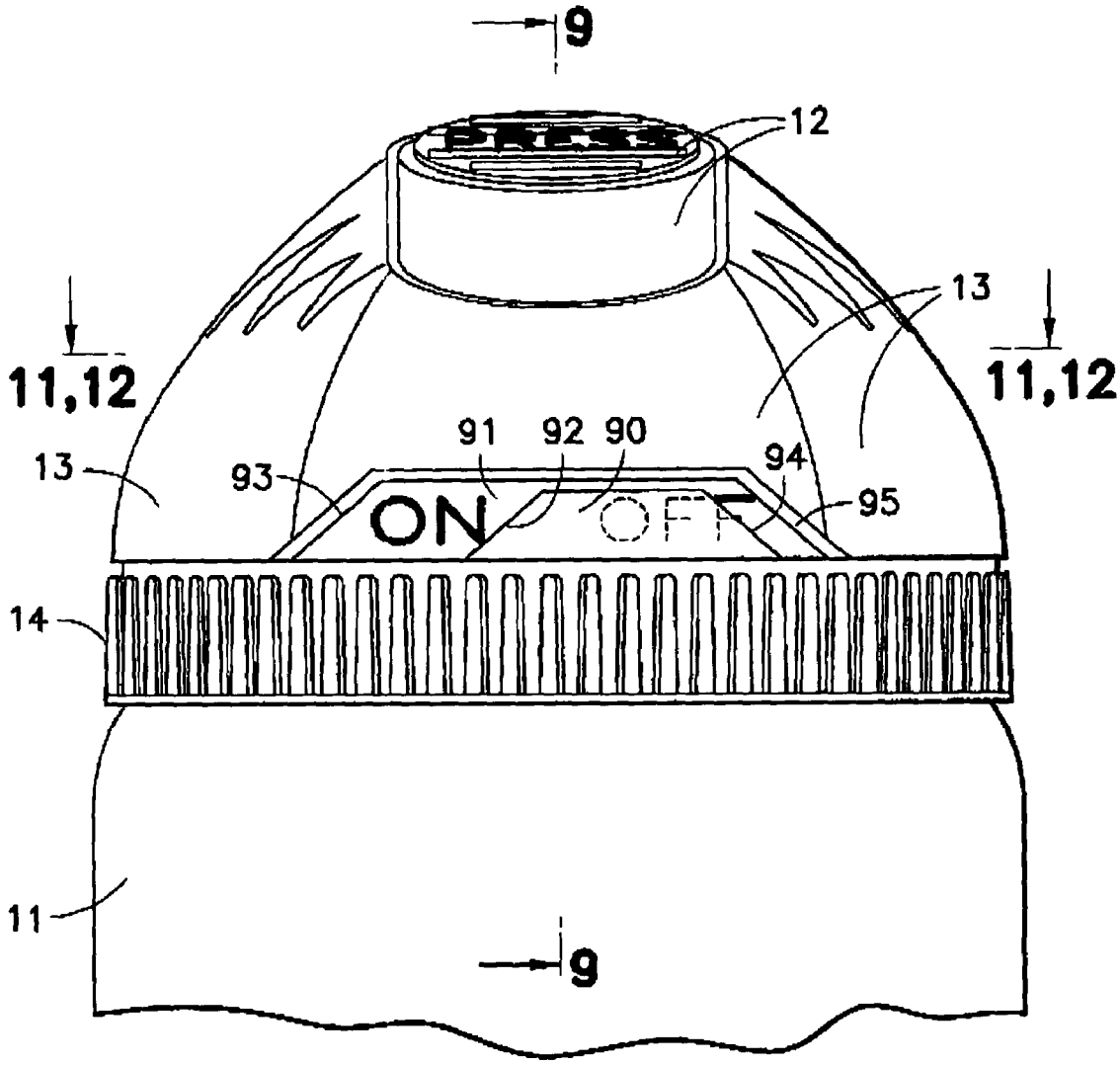
FIG. 6 is a rear view of the locking aerosol dispenser of the present invention mounted on the top of an aerosol container.

Referring to FIGS. 1, 3 and 6, locking aerosol dispenser 10 of the present invention is illustrated as assembled, with FIGS. 3 and 6 showing dispenser 10 mounted on the top of aerosol product container 11. FIG. 2 is an exploded view of locking aerosol dispenser 10, illustrating top button member 12, dome member 13, base lock member 14 and nozzle insert member 15. When the assembled aerosol dispenser 10 is mounted on the aerosol container 11, rotatable base lock member 14 can be rotated between a locking position and an unlocking position with respect to non-rotatable dome member 13 as hereinafter described. Only when the dispenser 10 is unlocked can product be dispensed from container 11.

Dome member 13 includes a top opening 16 before top button member 12 is applied as hereinafter described, and further includes product channel member 17 which extends upwardly inside dome member 13 towards its top and then outwardly in dome member 13 to nozzle 18. The product channel member 17 (also see FIG. 13) includes top surfaces 19, nozzle 18 and front plate 20. The bottom end of product channel member 17 will mount upon the aerosol valve stem of the aerosol container 11. Product channel member 17 may initially be molded along with and attached to dome 13 by frangible tabs 22 and 23 which break when the aerosol dispenser is first assembled or when first used by the consumer.

Referring to FIGS. 1-4, top button member 12 is a softer thermoplastic elastomer (for example, Santoprene) that is overmolded onto a harder plastic (for example, polypropylene) dome member 13 to create the button member 12. Button member 12 when formed by conventional overmolding will cover the top hole 16 in dome 13, will firmly adhere by virtue of the overmolding to top surfaces 19 of the product channel member 17, and will extend out onto and firmly adhere to the top surfaces of dome 13 surrounding top hole 16. As shown, the side portions of button member 12 overmolded out onto the dome 13 surfaces are illustrated as ornamental flares 21, but any particular form of such ornamentation is not a part of the present invention. Product channel member 17 is positioned and supported within dome 13, after frangible tabs 22, 23 are broken, only by the above-described adherence of button member 12 and is otherwise not attached to the dome. When formed, the top of button member 12 over product channel member 17 may be pressed downwardly by the dispenser user, due to the inherent resiliency of the thermoplastic elastomer in the areas overlying dome top hole 16. The pressing downward of button member 12 will lower product channel member 17 in the dome, including its front plate 20 and nozzle 18, to actuate the aerosol valve when the dispenser is in the unlocked position as hereinafter described. Actuation of the valve will result in product in container 11 passing upwardly and outwardly through product channel member 17 to exit its nozzle 18. Product channel member 17 moves essentially only in a vertical direction, thus requiring less force to actuate the aerosol valve and avoiding undue stress on the valve stem.

Figure 10:
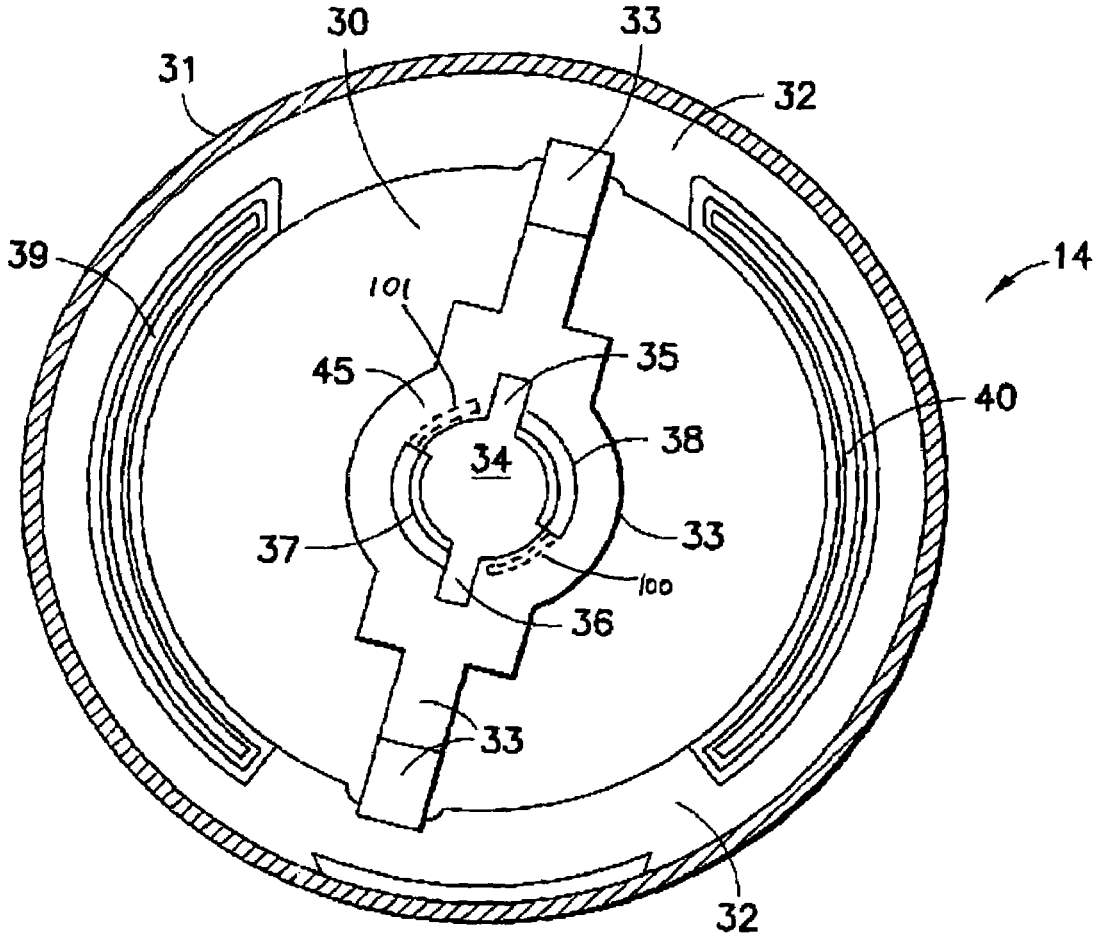
FIG. 10 is an overhead plan view of the base locking member of the present invention.

Rotatable base lock member 14 is captured between dome member 13 and container 11 when the locking aerosol dispenser 10 is assembled and mounted on the container. Base lock member 14 is not otherwise attached to the container 11 or to the aerosol valve mounting cup of the container, and its side wall is spaced radially outward from the mounting cup, whereby base lock member 14 is easy to rotate. Base lock member 14 as shown in particular in FIGS. 2 and 10 has a central opening 30, side wall 31, a top peripheral surface 32, and a bridge member 33. Bridge member 33 extends upwardly from peripheral surface 32 and above and across central opening 30. Bridge 33 further has a central opening 34 for the aerosol valve stem and product channel member, and unlocking slots 35 and 36 positioned adjacent central opening 34. Upstanding arcuate flanges 37 and 38 adjacent central opening 34 serve to stabilize and guide the bottom of product channel member 17 in dome 13. Arcuate open-topped channels 39 and 40 on top peripheral surface 32 of the base lock member serve for attaching the dome member 13 to base lock member 14 upon assembly of such for handling and shipping before the aerosol dispenser 10 is mounted by the product filler or product seller on container 11.

Figure 5:
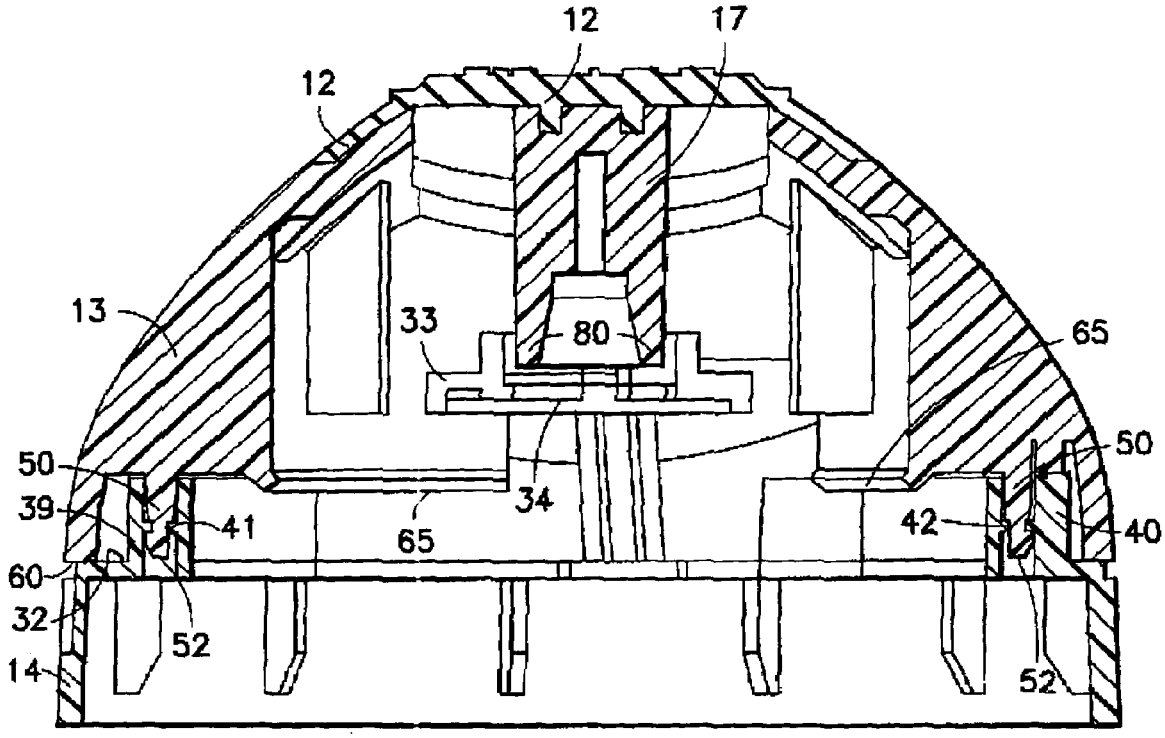
FIG. 5 is a cross-sectional view taken along lines 5-5 of FIG. 4.
Figure 8:
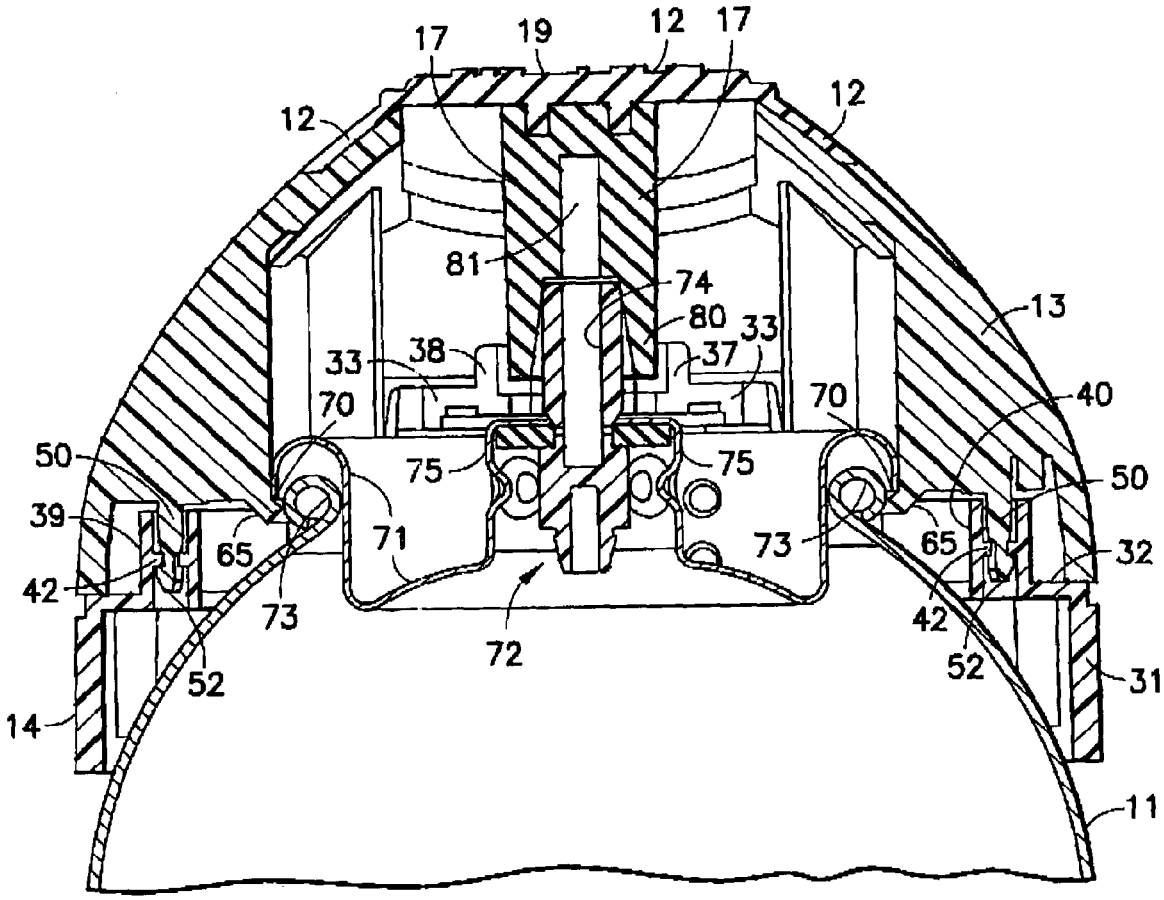
FIG. 8 is a view directly corresponding to FIG. 5, and additionally showing the mounting cup and valve stem of the aerosol valve in cross-section mounted in conventional fashion at the top of the aerosol container.

Turning to FIGS. 5 and 8, dome member 13 includes a plurality of internal downwardly extending ribs 50 that extend into the open topped channels 39 and 40 of base lock member 14. In one particular embodiment, there are three such circumferentially spaced ribs 50 extending into channel 39 and three more such circumferentially spaced ribs 50 extending into channel 40, at least one of such ribs in each of channels 39 and 40 having a prong 52 on its end snapping past wall protrusions 41 and 42 extending into and along channels 39 and 40. The dome member 13 is thereby assembled and secured to base lock member 14 for handling and shipping prior to mounting of the locking aerosol dispenser 10 onto the container 11. The plurality of circumferentially spaced dome ribs 50 extending into arcuate channels 39 and 40 of the base lock member also aid to properly align and position dome 13 onto base lock 14. When base lock member 14 is rotated about its central vertical axis with respect to overlying dome member 13, the plurality of ribs 50 slide along in channels 39 and 40. Upon assembly, the bottom 60 of dome member 13 may also sit upon the top peripheral surface 32 of base lock member 14.

Figure 9:
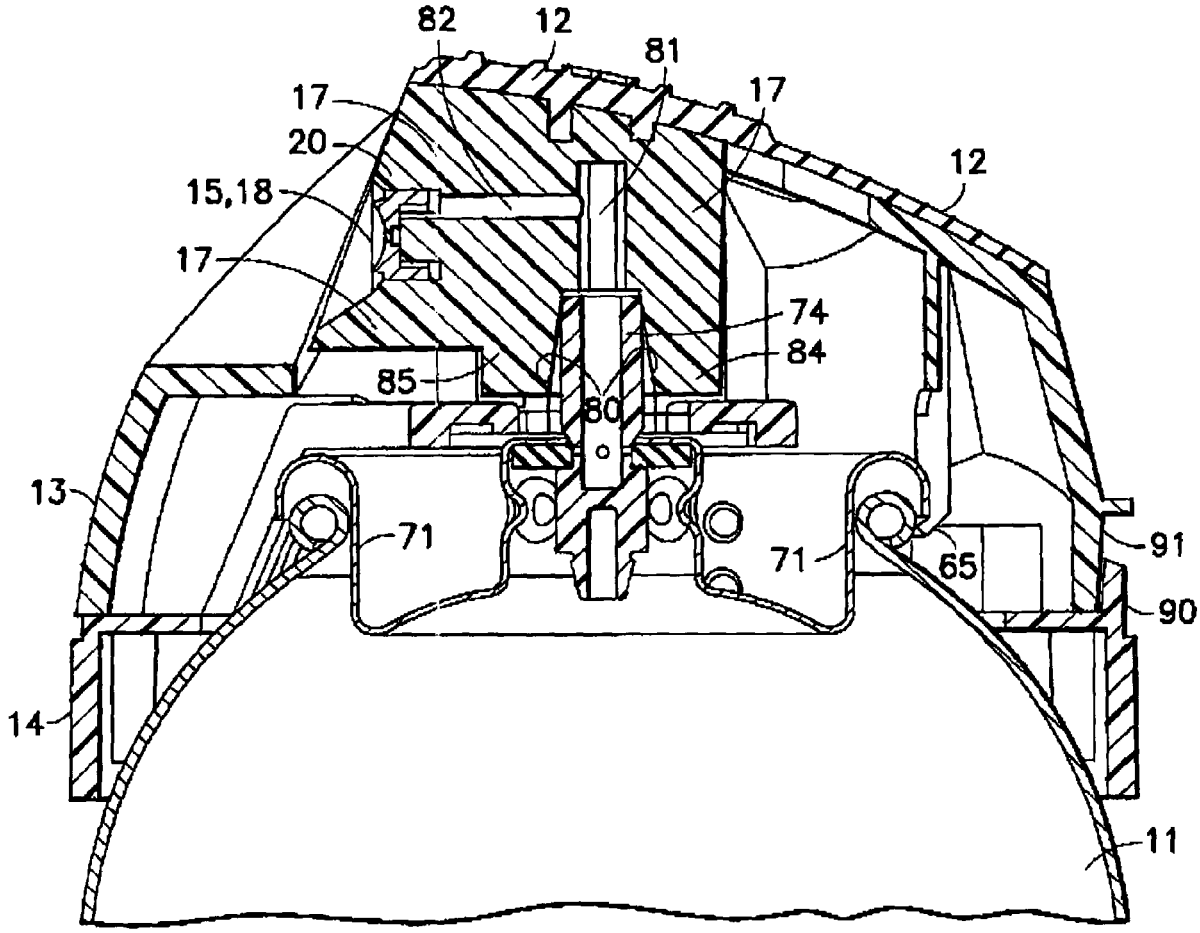
FIG. 9 is a cross-sectional view taken along lines 9-9 of FIG. 6, and additionally showing the mounting cup and valve stem of the aerosol valve in cross-section mounted in conventional fashion at the top of the aerosol container.

Referring now to FIGS. 5, 7, 8 and 9, dome member 13 has internal flanges 65 which serve as shown in FIGS. 8 and 9 to snap under the edge 70 of the conventional mounting cup 71 of the conventional aerosol valve 72 having valve stem 74. For ease of illustration, FIGS. 8 and 9 show the mounting cup 71 not fully mounted and crimped with its usual sealing gasket onto bead 73 of container 11 as it will be in actual practice. Dome member 13 is therefore attached to the mounting cup 71 and captures base lock member 14 between dome 13 and container 11 when the locking aerosol dispenser of the present invention is mounted on container 11 for use. As previously noted, dome member 13 is essentially non-rotatable upon assembly in the sense that it securely snaps under the edge of the mounting cup and is not intended to be rotated by the user in locking and unlocking the actuator. It is the base lock member 14 that is easily rotatable by the user's hand when the dispenser is operated between a locking and a non-locking position.

Figure 12:
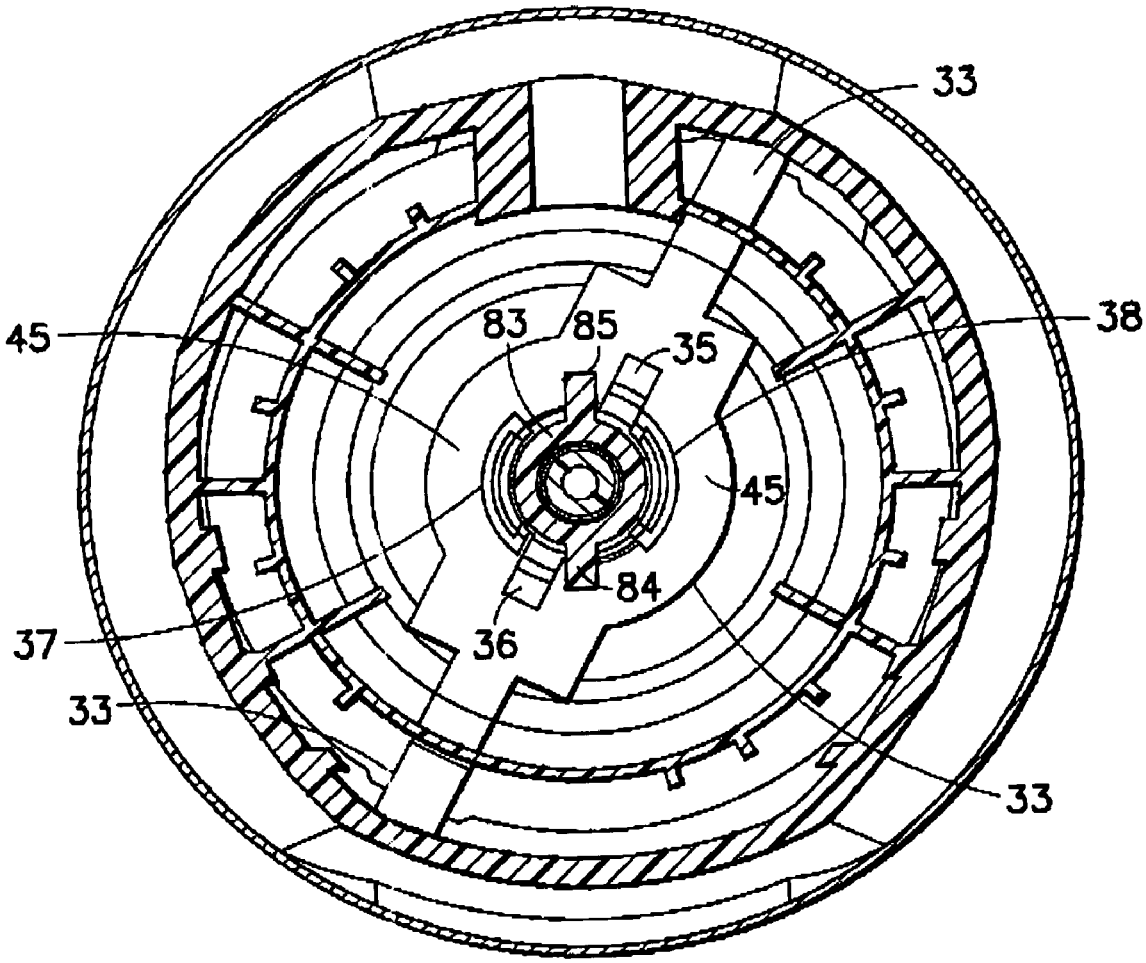
FIG. 12 is a cross-sectional view taken along lines 12-12 in FIG. 6 and illustrating the locking aerosol dispenser in the off-locked position.
Figure 13:
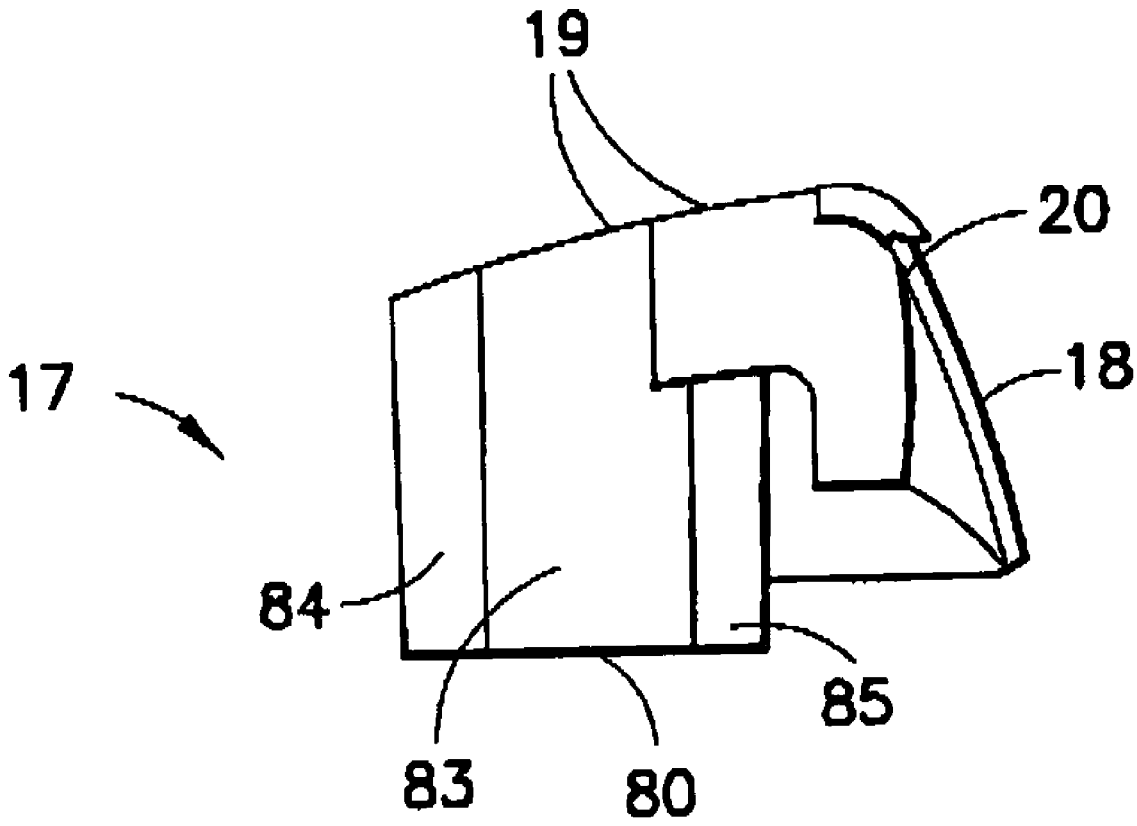
FIG. 13 is a side view of the product channel member of the present invention.

Further referring to FIGS. 8, 9 and 13, product channel member 17 of dome 13 includes a bottom portion 80 which fits over aerosol valve stem 74. Contained within product channel member 17 is upwardly extending product conduit 81 and outwardly extending product conduit 82 leading to nozzle 18. Product channel member 17 along its upstanding portion 83 has lateral finger extensions (fins) 84 and 85 on its side wall as best seen in FIGS. 2, 7, 9, 11, 12 and 13. Lateral finger extensions 84 and 85 can extend within slots 36 and 35 of bridge 33 on base lock member 14 when the base lock member 14 has been rotated to the unlocked position (See FIG. 11). When the base lock member 14 is rotated out of the unlocked position, lateral finger extensions 84 and 85 no longer can extend within slots 36, 35 (see FIG. 12).

Figure 7:
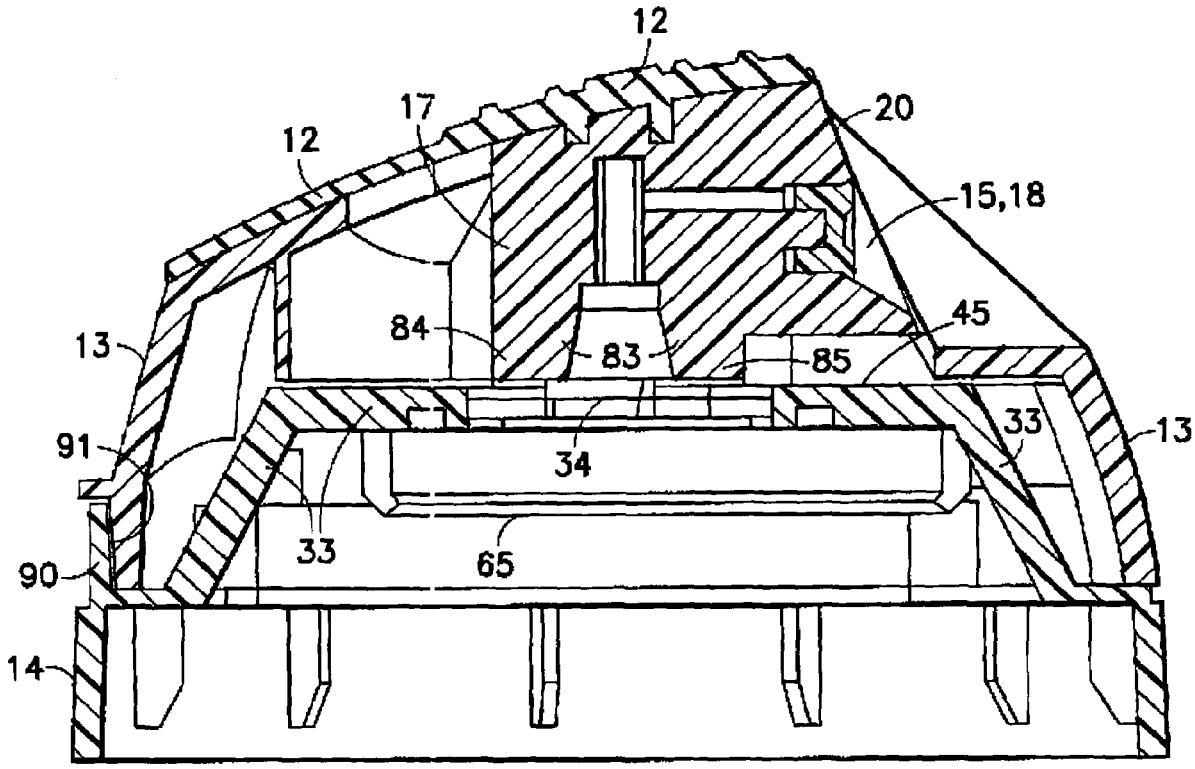
FIG. 7 is a cross-sectional view taken along lines 7-7 of FIG. 4.

Indicia means are provided for the locking aerosol dispenser 10 to indicate to the user the dispenser on-unlocked and off-locked positions. Referring to FIGS. 2, 6 and 7, base lock member 14 has an upstanding flange 90 and dome member 13 has a surface depression 91 within which flange 90 extends. Surface depression 91 has the words "ON" and "OFF" (or other indicia) imprinted thereon. When base lock member 14 is rotated, its flange 90 will obscure either the word "ON" or the word "OFF" to indicate for the user the operable condition of the aerosol dispenser 10. When rotated to the "OFF" position, edge 92 of flange 90 will hit against edge 93 of depression 91 to stop further rotation of base member 14 and show the word "OFF". When rotated in the opposite direction to the "ON" position, edge 94 of flange 90 will hit against edge 95 of depression 91 to stop further rotation of base member 14 and show the word "ON".

Figure 11:
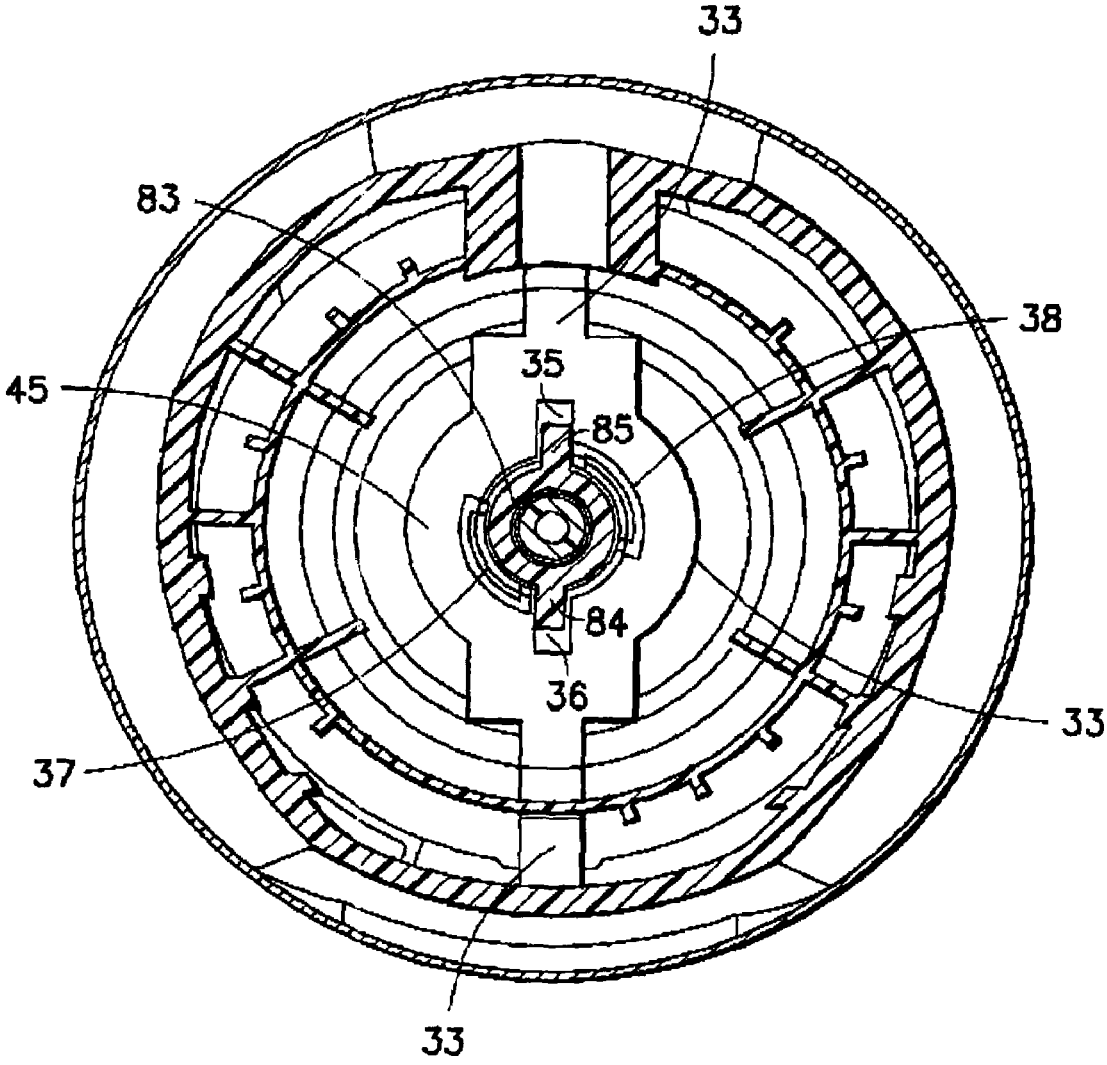
FIG. 11 is a cross-sectional view taken along lines 11-11 in FIG. 6 and illustrating the locking aerosol dispenser in the on-unlocked position.

Turning now to the operation of locking aerosol dispenser 10, when base lock member 14 is rotated about its vertical axis to the on-unlocked position, the side finger extensions 84, 85 of product channel member 17 overlie slots 36, 35 in bridge 33 (See FIG. 11). In this position top button member 12 of the dispenser can be pressed by the user to depress attached product channel member 17. The top button elastomer is stretched in the process. Finger extensions 84, 85 then will extend down into slots 36, 35, and bottom portion 80 of product channel member 17 will extend down into opening 34 at the top of bridge 33. Therefore, valve stem 74 will likewise be depressed at the same time by product channel member 17 to actuate the aerosol valve 72 in conventional fashion, thereby passing product in container 11 up and through conduits 81 and 82 of product channel member 17 to exit nozzle 18 of the dispenser. When top button member 12 is released by the user, the conventional valve spring (not shown) of the aerosol valve 72 along with the contracting of the top button member elastomer, will force the valve stem 74 upwardly to its unactuated position, thereby also returning the product channel member lower part 80 and finger extensions 84, 85 respectively up and out of the bridge central opening 34 and bridge slots 36, 35. Base lock member 14 may now be rotated to the dispenser off-locked position. In that position, as shown in FIG. 12, finger extensions 84 and 85 will no longer overlie slots 36, 35. An attempt to actuate the dispenser by pressing on top button member 12 merely results in finger extensions 84 and 85 contacting top surface 45 of bridge 33 and preventing any further depression causing the aforesaid actuation of the aerosol valve. The aerosol valve can only be actuated when finger extensions 84, 85 can pass down into bridge slots 36, 35.

When using the present invention with aerosol valves having valve stems that run higher than usual, it may be desirable to elevate the product channel member slightly in relation to the top of the valve stem when the dispenser is positioned from the unlocked to the locked position. By so doing, pressure against top button member 12 in the locked position will not inadvertently provide any possibility of triggering the valve since the product channel socket will have a further downward distance to travel before fully seating against and depressing the top of the valve stem. One means of accomplishing this slight elevation, if thought to be advantageous, is to position ramps 100, 101 as shown in dotted lines in FIG. 10. Ramp 100 begins flush with top surface 45 of bridge 33 adjacent slot 36, and rises upwardly a slight amount as it extends to abut flange 38. Ramp 101 likewise begins flush with top surface 45 of bridge 33 adjacent slot 35 and rises upwardly a slight amount as it extends to abut flange 37. Therefore, when base lock member 14 is rotated from the unlocked to the locked position after valve actuation ceases, fingers 84, 85 will ride up ramps 100, 101 to accordingly slightly elevate product channel member 17 in relation to the top of the valve stem.

The top of bridge member 33 is spaced only slightly above the top of mounting cup 71 including its pedestal portion 75 in the assembled condition of the dispenser. Accordingly, when excess pressure for any reason (handling, misuse, shipping, etc.) is put onto top button member 12 when the dispenser is in the off-locked position, the bridge 33 will not collapse and damage to the dispenser is prevented. A very robust dispenser structure is thereby provided.

Additional features of the present invention may include a conventional audible click feature (not shown) whereby a rib on the rotating base lock member 14 will click against a rib on the stationary dome member 13 to audibly indicate to the user the relative operating position of the dispenser. Further, one or both of the arcuate open-topped channels 39, 40 in bridge 33 may contain a small dimple (not shown) to slightly interfere with the dome downwardly extending ribs 50 when the base lock member 14 is rotated from its off to on position, so as to prevent the dispenser being easily shifted accidentally from the off to on position when the dispenser is in someone's purse or luggage.

The numerous features of the present invention described above together define a unique, simple and robust locking aerosol dispenser which is easily manufactured and assembled, and which functions reliably, efficiently, and with ease for the consumer.

It will be appreciated by persons skilled in the art that variations and/or modifications may be made to the present invention without departing from the spirit and scope of the invention. The present embodiment is, therefore, to be considered as illustrative and not restrictive. It should also be understood that positional terms as used in the specification are used and intended in relation to the positioning shown in the drawings, and are not otherwise intended to be restrictive.

What is claimed is:

1. A locking aerosol dispenser for mounting on a product container having an aerosol valve with mounting cup and valve stem mounted at the top of the container, comprising in combination:

a rotatable base lock member rotatable between an on-unlocked position and an off-locked position, and having a central opening, a side wall, a top peripheral surface, and a bridge member extending upwardly above and across said central opening, said bridge member including a central valve stem opening and slots adjacent thereto; said rotatable base lock member being unattached to said mounting cup to facilitate ease of rotation;

a non-rotatable dome member mounted on and extending upward above said rotatable base lock member, said dome member having a flange for attachment of said dome member to the mounting cup upon mounting of the locking aerosol dispenser on the product container, said dome member capturing the rotatable base lock member between the dome member and the product container upon mounting the locking aerosol dispenser on the product container;

said dome member further including a product channel member having a nozzle at a forward position for dispensing product, a valve stem engaging portion at a lower position, and a product channel therebetween including an upstanding conduit extending upwardly from the stem engaging portion and a conduit leading toward the nozzle; said product channel member having lateral finger extensions on its side wall for fitting within said bridge slots when the base lock member is rotated to the on-unlocked position and the product channel member is depressed to actuate the valve, said lateral finger extensions being blocked by the bridge member when the base lock member is rotated to the off-locked position to prevent depression of the product channel member; and said dome including a button member at the top of the product channel for user depression thereof.

2. The locking aerosol dispenser of claim 1, wherein said dome member is attached to said rotatable base lock member upon assembly of the dome member to the base lock member.

3. The locking aerosol dispenser of claim 1, wherein said rotatable base lock member has a plurality of arcuate open-topped channels at its top peripheral surface and said dome member has a plurality of downwardly extending ribs which snap into the open-topped channels to hold the base lock member and dome member together while allowing relative rotation, upon assembly prior to mounting the locking aerosol dispenser onto the product container.

4. The locking aerosol dispenser of claim 1, wherein said button member at the top of the product channel is a thermoplastic elastomeric member molded onto the top of the product channel member and over an opening in the top of the dome and onto dome surfaces adjacent the opening in the top of the dome.

5. The locking aerosol dispenser of claim 1, wherein the central valve stem opening of the bridge member has adjacent upstanding arcuate flanges to stabilize and guide the product channel member of the dome.

6. The locking aerosol dispenser of claim 1, wherein the dome member has an outer wall, the base of which rests upon and is supported by the top peripheral surface of the base lock member.

7. The locking aerosol dispenser of claim 1, wherein the mounting cup is directly adjacent to and supports the bridge member against excessive downward pressure exacted thereagainst by the product channel member while in its off-locked position.

8. The locking aerosol dispenser of claim 1, wherein the side wall of the base lock member is spaced radially outward from said mounting cup.

9. A locking aerosol dispenser for mounting on a product container having an aerosol valve with mounting cup and valve stem mounted at the top of the container, comprising in combination:

a rotatable base lock member rotatable between an on-unlocked position and an off-locked position, and having a central opening, a side wall, a top peripheral surface, and a bridge member extending across said central opening, said bridge member including a central valve stem opening and slots adjacent thereto;

a non-rotatable dome member mounted on and extending upward above said rotatable base lock member, said dome member capturing the rotatable base lock member between the dome member and the product container upon mounting the locking dispenser on the product container;

said dome member further including a product channel member having a nozzle at one position for dispensing product, a stem engaging portion at another position, and a product channel therebetween including an upstanding conduit extending upwardly from the stem engaging portion and a conduit leading toward the nozzle; said product channel member having lateral finger extensions on its side wall for fitting within said bridge slots when the base member is rotated to the on-unlocked position and the product channel member is depressed to actuate the valve, said lateral finger extensions being blocked by the bridge member when the base lock member is rotated to the off-locked position to prevent depression of the product channel member;

said dome including a button member at the top of the product channel for user depression thereof, said button comprising a thermoplastic elastomeric member molded onto the top of the product channel member and over an opening in the top of the dome and onto dome surfaces adjacent the opening in the top of the dome.

10. The locking aerosol dispenser of claim 9, wherein said dome member is attached to said rotatable base lock member, while allowing relative rotation therebetween, upon assembly of the dome member and base lock member prior to mounting the locking aerosol dispenser onto the product container.

11. The locking aerosol dispenser of claim 10, wherein said dispenser has a flange for snapping under the mounting cup edge.

12. The locking aerosol dispenser of claim 9, wherein said bridge member extends upward and across said central opening.

13. The locking aerosol dispenser of claim 9, wherein said rotatable base lock member is unattached to said mounting cup to facilitate ease of rotation.

14. The locking aerosol dispenser of claim 11, wherein said dome member has a flange for attachment of said dome member to the mounting cup upon mounting of the dispenser on the product container.

15. The locking aerosol dispenser of claim 9, wherein the product channel member is unconnected to the dome member except by the thermoplastic elastomeric button member.

16. The locking aerosol dispenser of claim 1 or claim 9, wherein the base lock member has an upstanding peripheral flange extending and rotatable within a surface depression on the dome for indicating the off and on positions of the dispenser.

17. The locking aerosol dispenser of claim 1 or claim 9, wherein ramps rise adjacent said slots in the bridge member to elevate the product channel member slightly in relation to the valve stem top when the dispenser is positioned from the unlocked to the locked position.

18. The locking aerosol dispenser of claim 1 or claim 9, wherein the motion of the product channel member is essentially in the vertical direction.

* * * * *